US005395464A

United States Patent [19]

Davidson

[11] Patent Number: 5,395,464

[45] Date of Patent: Mar. 7, 1995

[54] PROCESS OF GRAIN ENLARGEMENT IN CONSOLIDATED ALLOY POWDERS

[75] Inventor: James Davidson, Varennes-Vauzelles, France

[73] Assignee: TECPHY, Imphy, France

[21] Appl. No.: 224,194

[22] Filed: Apr. 7, 1994

Related U.S. Application Data

[63] Continuation of Ser. No. 641,777, Jan. 16, 1991, abandoned.

[30] Foreign Application Priority Data

Jan. 16, 1990 [FR] France ..... 90 00454

[51] Int. Cl.[6] ..... C22F 1/10

[52] U.S. Cl. ..... 148/675; 148/405; 148/409; 419/30; 419/31; 419/39; 419/49; 419/53; 419/68

[58] Field of Search ..... 148/405, 409, 675; 419/30, 31, 39, 49, 53, 68; 75/238, 241, 244, 246

[56] References Cited

U.S. PATENT DOCUMENTS 4,732,622 3/1988 Jones ..... 419/31
5,009,704 4/1991 Banik ..... 419/39

*Primary Examiner*—Richard O. Dean
*Assistant Examiner*—Robert R. Koehler
*Attorney, Agent, or Firm*—Pollock, Vande Sande & Priddy

[57] ABSTRACT

A method for obtaining a product from pre-alloyed powders in which the powders are subjected to compaction treatment. The powders are first subjected to pre-treatment under low pressure (or without pressure) at a temperature such that segregating materials precipitate out in stable phases.

10 Claims, 2 Drawing Sheets

PROCESS OF GRAIN ENLARGEMENT IN CONSOLIDATED ALLOY POWDERS

This application is a continuation of application Ser. No. 07/641,777, filed Jan. 16, 1991, now abandoned.

FIELD OF THE INVENTION

The present invention relates to a method for obtaining a product from prealloyed powders, and more particularly a method in which the powders are subjected to a compaction treatment.

This invention also relates to the products obtained by use of the method.

BACKGROUND OF THE INVENTION

It is known that powder metallurgy, which has been undergoing development for several years, can be used in particular to manufacture parts from metals which it would be impossible or difficult to manufacture otherwise, for example from super alloys. Because of this development powder metallurgy has in particular major applications in the field of aeronautical manufacture (turbine components).

However, although the materials produced using current methods of manufacture have excellent mechanical properties at medium temperatures, as a result of the fineness of the grains, their behavior at high temperatures (above 650° C.) is not always satisfactory, in particular as regards their resistance to creep and their resistance to crack propagation.

SUMMARY OF THE INVENTION

It is an object of the invention to provide a method for obtaining products from prealloyed super alloy powders which overcomes this problem.

Surprisingly, whereas until now in powder metallurgy the materials obtained have been marked by a very fine metallurgical grain size, the invention proposes a method of manufacture which involves treatments intended to enlarge the size of the grains, the size of the powder particles being nevertheless still initially limited by screening, and the scale of the segregations being reduced to dimensions which do not exceed the size of these particles.

It is known in conventional metallurgy that it is possible to enlarge the size of the grains in an alloy by subjecting it to heat treatment. However, in the context of powder metallurgy such heat treatments prove in practice be ineffective, it being very difficult for example, to enlarge the grain of an alloy obtained from powders having a diameter less than 106 micrometres beyond 7 in the ASTM standard.

In attempting to analyze the causes of these limitations, the applicant has observed that during stages of densification, for example during hot isostatic pressing or extrusion, the elements which become segregated at the surface of the powder particles (mainly carbon and oxygen) precipitate there, thus forming stable networks which it is impossible to resorb by subsequent treatment. As a consequence, interparticle fractures are favored and it is impossible to enlarge the grain size. Because of this, the grain size is limited to that of the particles of the initial powder.

In one of its principal aspects, the invention provides a method of manufacture in which one stage is a treatment whereby "decoration" of the particles by the precipitation of segregated elements is attenuated. More particularly, the arrangement adopted by the applicant consists of subjecting alloy powders to heat treatment under low pressure (or without pressure) prior to compaction, during which the segregated elements precipitate out internally, in phases which are stable at the compaction temperature, and no longer on the surface of the particles while compaction is in progress.

Furthermore, in the course of his analysis, the applicant also observed that grain enlargement treatments involving an increase in temperature were limited by incipient melting phenomena, i.e., the onset of local melting, making it impossible to treat, which prevents the powder alloy at the desired temperatures.

In order to overcome this further limitation, the invention provides, in combination with the aforesaid treatment without pressure or with a low pressure, that alloy powders be subjected to homogenization treatments so as to bring about structural uniformity in the materials in order to increase as much as possible the temperature at which incipient melting phenomena occur.

More particularly, in the case of precipitation hardened alloys, the homoginization treatments according to the invention are heat treatments above the solvus temperature of the alloy.

The invention therefore relates to a method for obtaining a product from prealloyed powders, in which the powders are subjected to a compaction treatment, powders being first subjected to pretreatment without pressure or under low pressure at a temperature at which segregating material precipitates out in stable phases.

Advantageously, where the alloy obtained is a precipitation hardened alloy, the temperature for precipitating the segregated element during the pretreatment of the powders without pressure or under low pressure is selected in the range from approximately 100° C. below the solvus temperature of the alloy up to its melting point (solidus).

Again advantageously, again where the alloy obtained is a precipitation hardened alloy, one of the stages in the method is heat treatment at a temperature above the solvus temperature of the alloy.

Preferably the compaction treatment includes a stage of low pressure compaction.

Again preferably, the compaction treatment incorporates a consolidation stage, in particular by hot isostatic pressing or extrusion. The compaction treatment may also incorporate a stage of low pressure compaction and a subsequent consolidation stage.

In a preferred embodiment, heat treatment at a temperature above the solvus temperature of the alloy is performed after the compaction treatment.

In another preferred embodiment the heat treatment at a temperature above the solvus temperature of the alloy is applied during pretreatment without pressure or under low pressure and/or during the compaction treatment. The consolidation stage may in particular comprise isostatic pressing at a temperature higher than the solvus temperature of the alloy.

The invention also relates to a precipitation hardened alloy product obtained by the method, and more particularly a nickel-based super alloy product.

Finally, yet another object of the invention is the use of products obtained by means of the method in critical parts operating at high temperatures, for example in excess of 650° C., and more particularly the use of such products for the manufacture of critical parts in the field of aeronautical construction.

BRIEF DESCRIPTION OF THE DRAWINGS

The invention will now be described with reference to the appended drawings.

DESCRIPTION OF THE PREFERRED EMBODIMENT

Figure 1:
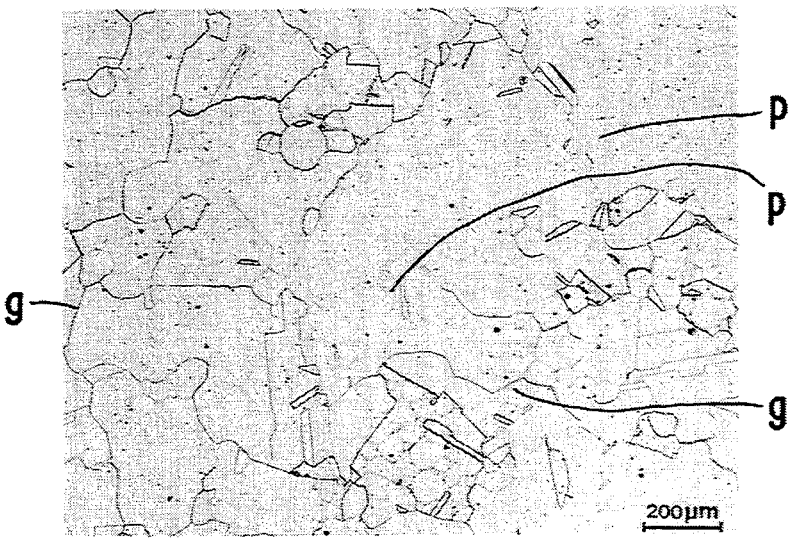
FIG. 1 shows a photomicrograph which illustrates, for a first alloy, the growth of metallurgical grains beyond the boundaries of the initial powder particles as a result of the use of a method according to the invention.

The method according to the invention has been used to obtain a first alloy known commercially as ASTROLOY® (trade mark), whose composition by weight is as follows: zirconium 0.040%, boron 0.023%, carbon 0.020%, titanium 3.5%, aluminum 4%, molybdenum 5%, chromium 15%, cobalt 17%, balance nickel. This alloy has a solvus temperature of 1140° C.

A conventional method for obtaining a product based on prealloyed powder in the abovementioned proportions by weight consists of high temperature densification treatment under pressure, for example heat treatment under 100 MPa for six hours. Table A below gives the sizes of the grains obtained, in accordance with the ASTM standard, in relation to the temperature of this heat treatment, for powder particles having a mean diameter of less than 75 micrometres.

TABLE A

| ASTROLOY | Treatment(s) | ASTM standard grain sizes |
|---|---|---|
| Methods according to the state of the art | 1120° C. 6 h 100 MPa | 10 |
| | 1160° C. 6 h 100 MPa | 7 |
| | 1200° C. 6 h 100 MPa | 6 |

An example of a method according to the invention consists of the prior heat treatment of powders under low pressure (less than 1 atm) or without pressure for 24 hours, followed by compaction heat treatment in which one stage is a hot isostatic pressing stage at 1160° C. and 100 MPa for six hours, this isostatic pressing stage being possibly followed by treatment for four hours at a temperature of 1200° C.

The grain sizes obtained from initial powders having a mean diameter of less than 75 μm are given in Table B below:

TABLE B

| ASTROLOY | Treatment(s) | ASTM standard grain sizes |
|---|---|---|
| Methods according to the invention | 1120° C. 24 h + 1160° C. 6 h 100 MPa | 5 |
| | 1160° C. 24 h + 1160° C. 6 h 100 MPa | 3 |
| | 1160° C. 24 h + 1160° C. 6 h 100 MPa + 1200° C. 4 h | 1 to 3 |

It is clear from a comparison of Tables A and B that the use of a preheat heat treatment under low pressure or without pressure achieves an appreciable increase in the grain sizes of the products obtained.

It will also be noted from Table B that the grain sizes are very much larger when the pretreatment is performed at 1160° C., i.e., above the solvus temperature of the alloy, than when it is performed at 1120° C.

It is also found that the results for grain size are again very appreciably improved when the method of manufacture includes a final treatment stage at 1200° C., the metallurgical grain sizes being achieved then having an ASTM standard value of up to 1.

FIG. 1, which shows a photomicrograph of ASTROLOY alloy obtained using the method according to the invention quoted in Table B, which includes a final treatment stage at 1200° C., shows that the metallurgical grains, whose boundaries appear as continuous lines, have grown beyond the initial boundaries of the powder particles, which appear in the photomicrograph as dotted lines, due to the persistance of slight decoration despite the method used.

The process according to the invention has also been applied to obtain a second alloy known commercially as N18, whose composition by weight is as follows: zirconium 0.030%, boron 0.015%, carbon 0.015%, hafnium 0.25%, titanium 4.35%, aluminum 4.35%, molybdenum 6.5%, chromium 11.5%, cobalt 15.7%, balance nickel. This alloy has a solvus temperature of 1195° C.

Table C shows the grain sizes obtained for this second alloy using conventional methods, i.e., by hot isostatic pressing under 100 MPa for six hours, for different compaction temperatures, the initial powders having a mean diameter of less than 75 μm.

TABLE C

| N 18 | Treatment(s) | ASTM standard grain sizes |
|---|---|---|
| Methods according to the state of the art | 1120° C. 6 h 100 MPa | 10 |
| | 1160° C. 6 h 100 MPa | 9 |
| | 1200° C. 6 h 100 MPa | 7 |

Table D shows values for the alloy grain sizes obtained for initial powders having similar dimensions using methods according to the invention. These methods each include pre-heat treatment under low pressure (less than 1 atm) or without pressure, followed by compaction treatment. Such compaction treatment may include a stage of consolidation by conventional hot isostatic pressing, which may or may not be followed by a subsequent consolidation stage. The consolidation treatment may also consist of a stage of isostatic pressing under low pressure followed by a subsequent compaction stage.

TABLE D

| N 18 | Treatment(s) | ASTM standard grain sizes |
|---|---|---|
| Methods according to the invention | 1160° C. 24 h + 1200° C. 6 h 100 MPa | 5 |
| | 1160° C. 24 h + 1160° C. 6 h 100 MPa + 1200° C. 4 h | 5 |
| | 1170° C. 24 h + 1170° C. 4 h 10 MPa + 1200° C. 6 h 100 MPa | −1 to −2 |
| | 1200° C. 24 h + 1160° C. 6 h 100 MPa + 1200° C. 6 h 100 MPa | 4 |

From a comparison of Tables C and D it will be seen that the preheat heat treatment of powders under low pressure yields alloys having large grain sizes, in particular an ASTM standard value of 5 or less.

It should also be noted that the results obtained for grain size are better when the pretreatment or heat treatment temperatures are higher than the solvus temperature of the alloy (1195° C.).

It will also be noted that the results obtained with an intermediate low pressure (10 MPa) isostatic pressing stage are very appreciably superior to the others, the grain sizes achieved being up to −2 in the ASTM standard.

Figure 3:
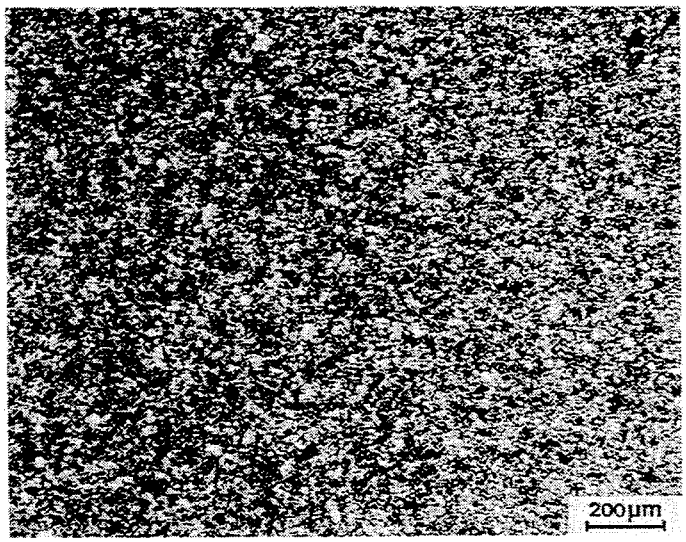
FIGS. 3 and 4 are photomicrographs illustrating, respectively, for the same second alloy, the differences in the sizes of the metallurgical grains of material obtained using a method according to the prior art (FIG. 3) and a method according to the invention (FIG. 4).
Figure 4:
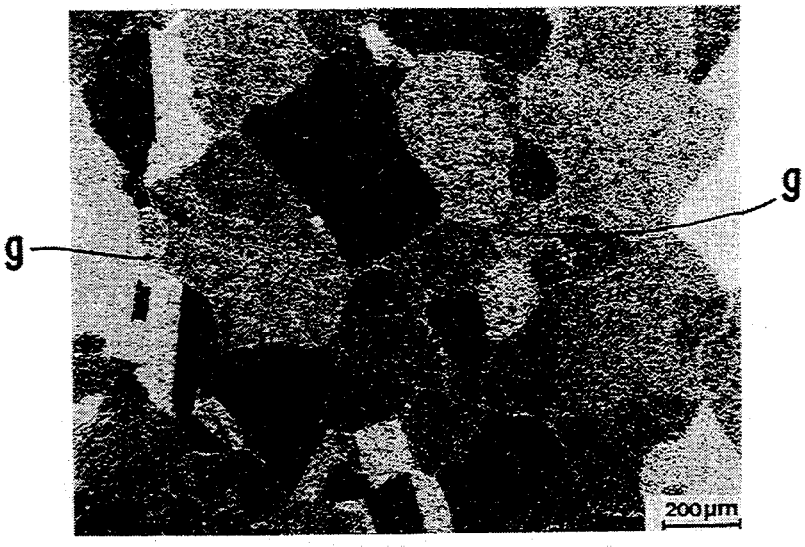

If reference is now made to FIGS. 3 and 4, which show photomicrographs of an N18 alloy treated in accordance with the state of the art under 100 MPa for 6 hours at 1160° C. and in accordance with a method according to the invention, consisting of pretreatment at 1170° C. for 24 hours followed by isostatic pressing under low pressure at 1170° C., for four hours under 10 MPa, then followed by subsequent compaction at 1200° C. under 100 MPa for six hours, respectively, it will be seen that the boundaries of the metallurgical grains formed in the alloy by the method according to the invention can be distinguished very clearly in FIG. 4, while the same boundaries are difficult to distinguish in the photomicrograph shown in FIG. 3, i.e., in the alloy obtained by a method according to the state of the art. The grains of the alloys obtained by the method according to the invention are very appreciably larger than those obtained using the method according to the state of the art.

Figure 2:
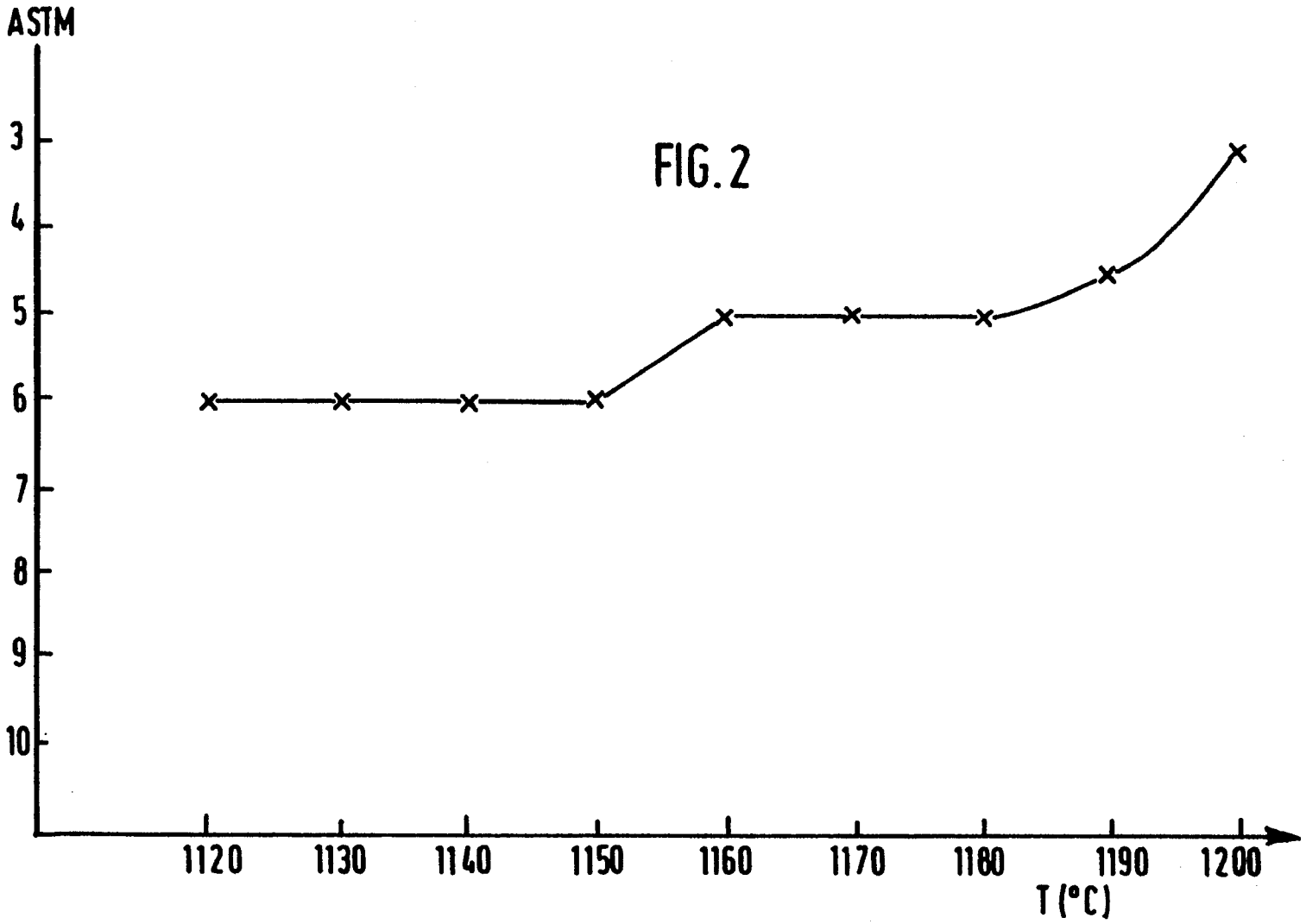
FIG. 2 is a graph illustrating the growth of the metallurgical grains in a second alloy as a result of the use of a method according to the invention.

If reference is now made to FIG. 2, which is a graph showing the standard ASTM grain sizes of the alloys obtained using the method according to the invention as a function of the pretreatment temperature to which the alloys were subjected for 24 hours, this pretreatment being followed by a stage of hot isostatic pressing at 1120° C. for six hours under 100 MPa, extended by a subsequent compaction stage at 1200° C. for six hours under 100 MPa, an appreciable increase in the grain sizes when the initial pretreatment temperature is above the solvus temperature of the alloy (1195° C.) will be noted.

What is claimed is:

1. A method of manufacture of a product having increased resistance to creep and crack propagation from prealloyed powder of a nickel-based superalloy, said method comprising the steps of:

(a) preparing a prealloyed powder of a nickel-based superalloy, particles of said powder having a size limited by screening, and having segregated elements on their surface;

(b) subjecting said powder to a preheat treatment of internally precipitating said segregated elements in stable phases inside said particles of powder, said preheat treatment being carried out under low pressure or without pressure and at a temperature below an incipient melting point of said superalloy;

(c) subjecting said powder to a consolidation treatment by hot compaction under high pressure for manufacturing said product; and (d) subjecting said product to a stage of enlarging the sizes of metallurgical grain of the alloy beyond the boundaries of the powder particles by heating at a temperature above the solvus temperature of the alloy.

2. A method of manufacture of a product having increased resistance to creep and crack propagation from prealloyed powder of a nickel-based superalloy, said method comprising the steps of:

(a) preparing a prealloyed powder of a nickel-based superalloy, particles of said powder having a size limited by screening, and having segregated elements on their surface;

(b) subjecting said powder to a preheat treatment of internally precipitating said segregated elements in stable phases inside said particles of powder, said preheat treatment being carried out under low pressure or without pressure and at a temperature below an incipient melting point of said superalloy;

(c) subjecting said powder to a consolidation treatment by hot compaction under high pressure for manufacturing said product;

(d) said hot compaction treatment comprising a stage of enlarging the sizes of metallurgical grain of said superalloy beyond boundaries of said particles by heating under high pressure at a temperature above a solvus temperature of said superalloy.

3. A method according to claim 1 or 2, wherein said preheat treatment is carried out under low pressure not exceeding 1 atm.

4. A method according to claim 1 or 2 , wherein said preheat treatment is carried out at a temperature between about 100° C. below said solvus temperature and said incipient melting point of said superalloy.

5. A method according to claim 4, wherein said preheat treatment is carried out at a temperature above said solvus temperature.

6. A method according to claim 1 or 2, wherein said stage of enlarging the metallurgical grains is performed under a pressure of about 100 MPa.

7. A method according to claim 1 or 2, wherein said consolidation treatment is carried out by hot isostatic pressing.

8. A method according to claim 7, wherein said consolidation treatment includes a stage of low pressure compaction and a subsequent hot isostatic pressure under high pressure.

9. A method according to claim 8, wherein at least one of said stages of compaction is carried out at a temperature above said solvus temperature of said superalloy.

10. A method according to claim 1 or 2, wherein the consolidation treatment is performed by extrusion.

* * * * *